US005433899A

United States Patent [19]

Goetz

[11] Patent Number: 5,433,899

[45] Date of Patent: Jul. 18, 1995

[54] PROCESS OF MANUFACTURING A GAS GENERATING MATERIAL

[75] Inventor: George W. Goetz, Rochester Hills, Mich.

[73] Assignee: TRW Vehicle Safety Systems Inc., Lyndhurst, Ohio

[21] Appl. No.: 931,137

[22] Filed: Aug. 17, 1992

[51] Int. Cl.[6] ..... C06B 21/00

[52] U.S. Cl. ..... 264/3.3; 149/109.6; 149/114; 241/17; 241/21; 241/46.17; 264/3.1; 264/3.4

[58] Field of Search ..... 241/17, 21, 46.17; 149/109.6, 114; 264/3.3, 3.4, 3.1

[56] References Cited

U.S. PATENT DOCUMENTS

| | | | |
|---|---|---|---|
| 3,036,614 | 5/1962 | Knapp | 241/46.17 |
| 3,068,527 | 12/1962 | Morgan | 241/21 |
| 3,595,487 | 7/1971 | Bidwell | 241/21 |
| 3,652,348 | 3/1972 | Baum | 149/108.8 |
| 3,908,040 | 9/1975 | Dauksys | 427/58 |
| 3,919,012 | 11/1975 | McBride | 149/2 |
| 3,966,855 | 6/1976 | Hollenberg | 264/65 |
| 4,072,546 | 2/1978 | Winer | 149/2 |
| 4,356,982 | 11/1982 | Nakabayashi et al. | 241/17 |
| 4,811,908 | 3/1989 | Galati | 241/21 |
| 4,817,828 | 4/1989 | Goetz | 280/736 |
| 4,999,063 | 3/1991 | Vos et al. | 149/109.6 |
| 5,084,218 | 1/1992 | Vos et al. | 264/3.3 |
| 5,133,506 | 7/1992 | Bogen | 241/46.17 |

*Primary Examiner*—Edward A. Miller
*Attorney, Agent, or Firm*—Tarolli, Sundheim & Covell

[57] ABSTRACT

Graphite fibers (62) are mixed with other materials (22) to form gas generating material (10) for use in an air bag inflator. The graphite fibers are first chopped to a desired short length by forming a mixture of fluid and relatively long graphite fibers in a container (50) having therein a rotatable blade (58), and rotating the blade continuously for a period of time to chop the graphite fibers to a shorter and more uniform length. The viscosity of the mixture in the container is increased as the blade rotates in the container, preferably through evaporation or boiling which counteracts the viscosity decreasing effect of fiber shortening.

15 Claims, 2 Drawing Sheets

PROCESS OF MANUFACTURING A GAS GENERATING MATERIAL

BACKGROUND OF THE INVENTION

1. Technical Field

The present invention relates to a process of manufacturing gas generating material. In particular, the present invention relates to a process of making graphite fibers for use in a material for generating gas to inflate a vehicle occupant restraint such as an air bag.

2. Description of the Prior Art

U.S. Pat. No. 4,999,063 discloses a process for manufacturing a gas generating material. The gas generating material includes graphite fibers for strengthening the bodies of gas generating material made by the disclosed process. The graphite fibers also promote thermal conductivity within the gas generating material.

Uniform distribution of the graphite fibers in the gas generating material is desirable to promote uniform burning of the bodies of gas generating material and to provide uniform strength. Applicant has found that graphite fibers which are relatively long can result in a non-uniform distribution of the graphite fibers in the gas generating material. This non-uniform distribution occurs because during the process of making the gas generating material, longer fibers tend to ball up and trap other fibers. This can result in a relatively large mass of graphite in one location in the gas generating material and no graphite in other locations in the gas generating material.

Prior art processes such as chopping can only shorten graphite fibers to a length of about 1/8 inch. Hammer milling will provide shorter fibers than chopping but does not produce a sufficiently uniform length distribution. The present invention is based on the observation that if the graphite fibers are shorter in length and if the length. distribution of the graphite fibers is as narrow as possible, a more uniform distribution of graphite fibers in the gas generating material will result. This will produce more uniform strength and uniform burning of the bodies of gas generating material.

SUMMARY OF THE INVENTION

The present invention is a process of making graphite fibers to provide short fibers of a narrow length distribution. The process includes the steps of: forming a mixture of graphite fibers and a fluid in a container having a rotatable blade; rotating the blade continuously for a period of time; and removing fluid from the mixture as the blade rotates in the container to increase the viscosity of the material in the container.

In a preferred embodiment, the present invention is an improvement in a process which includes the step of mixing graphite fibers with other materials, such as a metal azide and a metal oxide, to form gas generating material for use in an air bag inflator. The improvement includes the steps of placing fluid in a container having a rotatable blade and adding graphite fibers to the fluid in the container to form a mixture of fibers and fluid. The blade is rotated continuously for a period of time to chop the fibers to a short and uniform length distribution. The viscosity of the material in the container is increased as the blade rotates in the container, preferably by vaporizing of the fluid through evaporation or boiling. Graphite fibers can be shortened with the process of the present invention to an average length of about 1/250 of an inch.

BRIEF DESCRIPTION OF THE DRAWINGS

The foregoing and other features of the present invention will become apparent to one skilled in the art upon a consideration of the following description of the invention with reference to the accompanying drawings, wherein.

DESCRIPTION OF A PREFERRED EMBODIMENT OF THE INVENTION

Figure 1:
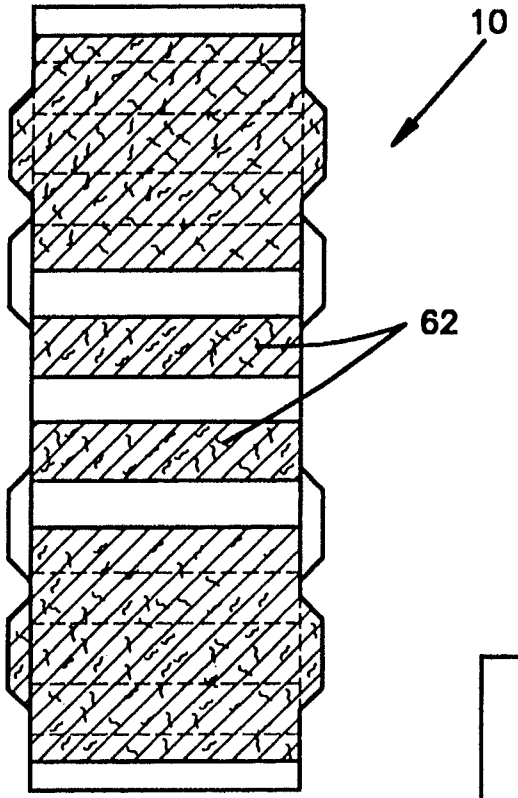
FIG. 1 is a sectional view of a body of gas generating material for use in a vehicle occupant restraint system and manufactured in accordance with the process of the present invention.

The present invention relates generally to a process of manufacturing gas generating material. In particular, 10 the present invention relates to a process of making graphite fibers for use in a gas generating material for generating gas to inflate a vehicle occupant restraint such as an air bag. As representative of the present invention, FIG. 1 illustrates a multi-holed, cylindrical body 10 of gas generating material made in accordance with the present invention. The body 10 includes a plurality of graphite fibers 62 made in accordance with the present invention. The body 10 (also known as a "grain") of gas generating material is used in an inflatable vehicle occupant restraint system (not shown) to generate, when ignited, gas to inflate an occupant restraint such as an air bag. The body 10, or a plurality of bodies 10, of gas generating material could be used in many different types of inflatable restraint systems. One inflatable restraint system in which the gas generating material may be used is described in U.S. Pat. No. 4,817,828, issued Apr. 4, 1989 and entitled "Inflatable Restraint System."

The gas generating material of which the body 10 is made includes a fuel which is a source of nitrogen gas and a primary oxidizer which is a primary source of oxygen. The gas generating material also contains a second oxidizer, an extruding aid, and a plurality of strengthening fibers 62. Graphite fibers are preferably used as the strengthening fibers, although glass fibers and/or iron fibers could be used. The gas generating material may have a composition as set forth in U.S. Pat. No. 4,999,063 issued Mar. 12, 1991 and entitled "Process for Manufacturing a Gas Generating Material."

The body 10 of gas generating material preferably has the following proportions of ingredients by weight:

| Ingredient | Amount | Range |
|---|---|---|
| Sodium azide ($NaN_3$) | 57.9% | ±10% |
| Iron oxide ($Fe_2O_3$) | 34.6% | ±10% |
| Graphite | 3% | 0 to 6% |
| Bentonite | 2.5% | 0 to 5% |
| Sodium Nitrate ($NaNO_3$) | 2% | 0 to 10% |

Figure 2:
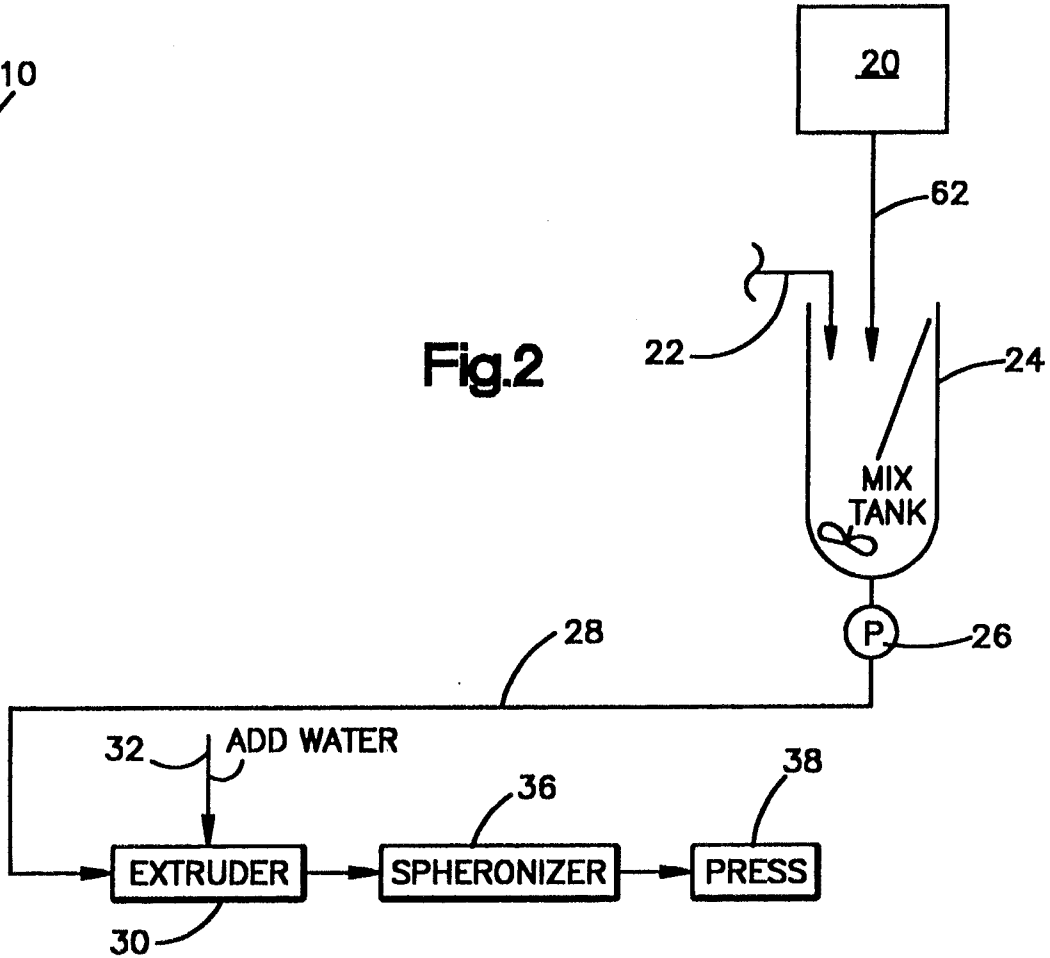
FIG. 2 is a schematic illustration depicting process equipment for forming the body of gas generating material illustrated in FIG. 1.

The gas generating material of which the body 10 is made is manufactured by process equipment illustrated schematically in FIG. 2. The process herein described is applicable to the manufacture of bodies having a multitude of pressed or extruded shapes, the preferred shape being shown in FIG. 1.

The process equipment illustrated schematically in FIG. 2 includes an apparatus 20 for chopping graphite fibers to provide short fibers of a narrow length distribution in a manner discussed in detail below. Graphite fibers 62 chopped to length in the apparatus 20 are sent to a mix tank 24. There they are mixed with the other constituents of the gas generating material received through a conduit 22. The materials in the mix tank 24 are preferably all dry materials.

The output of the mix tank 24 is sent by a pump or screw feeder 26 through a conduit 28 to an extruder 30. 10 Water is added as indicated by the arrow 32 to the dry material in the extruder 30. The output of the extruder 30 is sent to a spheronizer 36. The spheronizer 36 makes small balls of gas generating material which are sent to a pressing apparatus 38. The pressing apparatus 38 presses the gas generating material into its final shape, for example, the shape of the body 10 illustrated in FIG. 1.

Figure 3:
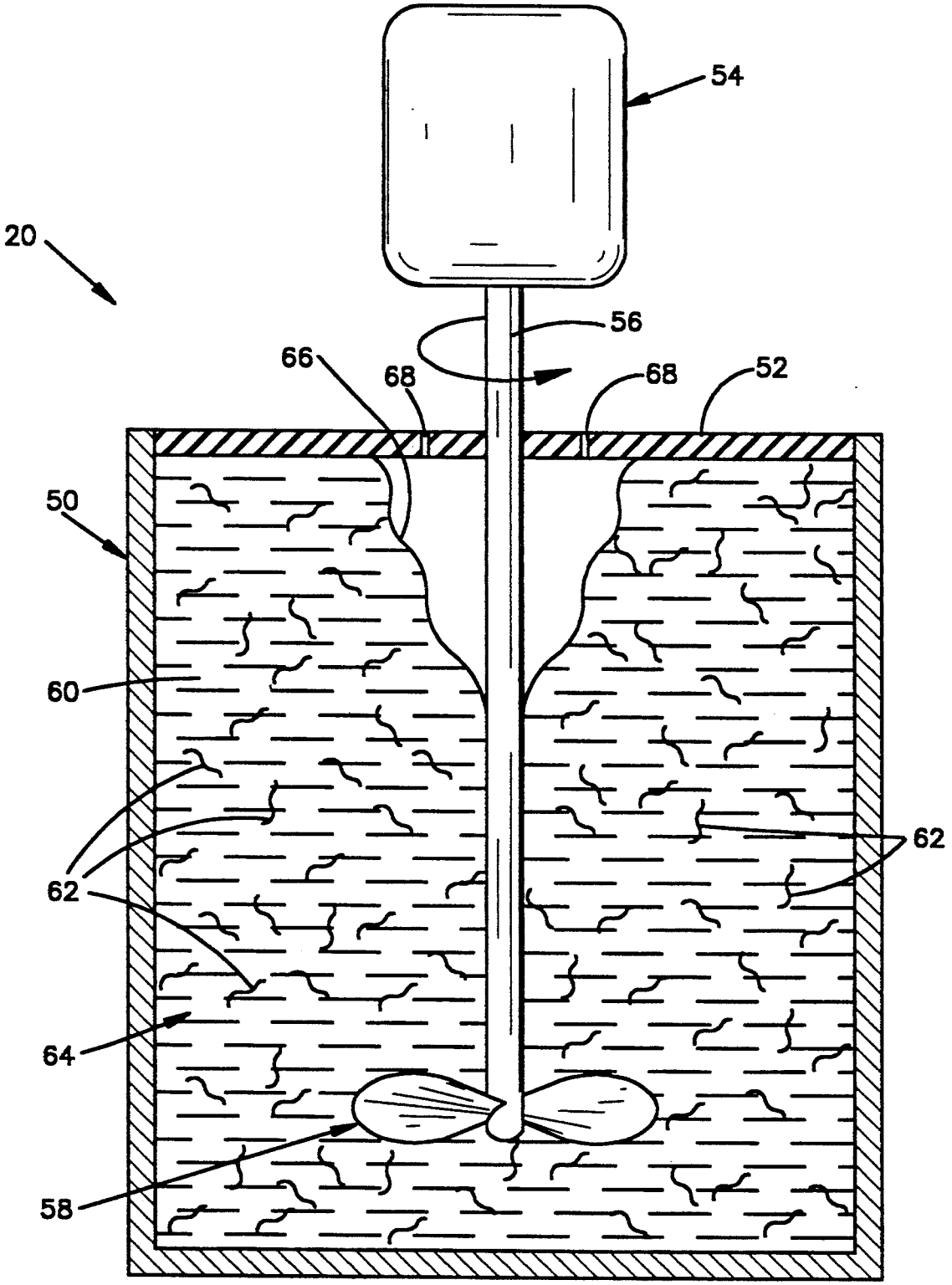
FIG. 3 is a schematic illustration depicting a graphite fiber chopping apparatus used in the process illustrated in FIG. 2.

The graphite fiber chopping apparatus 20 (FIG. 3) includes a container 50 having a lid 52. The container 50 is preferably a rectangular tank although other containers can be used. The lid 52 is preferably made of stainless steel, although rubber can be used to reduce adhesion of the graphite fibers to the lid. The lid may float to prevent splashing as the fluid level drops. A drive means 54, which may be an electric motor, rotates a shaft 56 and a blade 58 fixed to the shaft 56 and disposed within the container 50.

In the operation of the apparatus 20, a quantity of fluid 60 is placed in the container 50. The drive means 54 is actuated to rotate the blade 58 rapidly. Graphite fibers 62 are added to the fluid in the container 50 to form a fluid mixture 64. As the blade 58 rotates in the fluid mixture 64, the surface 66 of the fluid mixture 64 may be drawn down because of the rotation of the blade 58 and shaft 55. As the blade 58 rotates, it chops the graphite fibers 62 to a short and generally uniform length.

Rotation of the blade 58 in the fluid mixture 64 raises the temperature of the fluid mixture. An external heat source (not shown) may also be used to heat the fluid mixture 64. The mixture 64 is heated enough to boil or cause evaporation of the fluid 60. The vaporized fluid 60 is removed or drawn off from the mixture 64 through, for example, vents indicated schematically at 68 in the lid 52 of the container. As the fluid 60 is removed from the mixture 64, the viscosity of the mixture in the container 50 increases counteracting the viscosity lowering that occurs as the fibers shorten. The lid 52 may be attached to the container 50 in a manner such that the lid may be progressively lowered into the container as the fluid in the container boils away.

After the fibers 62 are chopped to the desired length, the fluid mixture 64 is removed from the container 50. The graphite fibers 62 are drained and then dried to remove any remaining fluid 60. Drying may be accomplished by, for example, heating at a temperature of about 500° F. for about 24 hours. The graphite fibers 62 are then ready for use in the process equipment illustrated in FIG. 2.

The graphite fibers 62 introduced into the fiber chopping apparatus 20 may be about one inch in length, which is a commercially available length. The fibers 62 can be shortened in accordance with the present invention to a length of about 100 microns (1/250th of an inch). The shortened graphite fibers exhibit a very narrow length 10 distribution curve. In other words, the great majority of the fibers are about the same average length, and the number of fibers which are longer or shorter than that average length drops exponentially with increasing and decreasing length relative to the average. The length distribution of the chopped fibers becomes narrower as the period of time of operation of the fiber chopping apparatus 20 becomes longer. It is believed that this result is achieved because as the mixture 64 becomes thicker, the rotating blade 58 only has the energy to break longer fibers and not shorter ones.

Graphite fibers shortened in accordance with the present invention have a far superior length distribution than can be obtained using prior art devices such as a Wiley Mill or a ball mill. The graphite fibers also have a shorter average length and a shorter maximum length, and exhibit a very narrow length distribution curve around the average length.

A comparison test burn showed that gas generating material using graphite fibers made in accordance with the present invention exhibited a faster burn rate and produced a better sinter than similar gas generating material using milled graphite fibers. The graphite fibers promote thermal conductivity in the gas generating material. It is believed that the shorter average length, narrower length distribution, and shorter maximum length of the graphite fibers produce this better burn capability, as well as a more uniform strength for the gas generating material prior to burning.

The shorter maximum length and the narrower length distribution curve of the graphite fibers 62 made according to the process of the invention minimize balling up of the graphite fibers when they are mixed with the other materials in the mix tank 24. Excessively long graphite fibers can Join together and trap short fibers in a ball or mass which will not be uniformly dispersed during the process illustrated in FIG. 2. This can undesirably produce a mass of undispersed graphite fibers in the body 10.

In one example of the present invention, a Waring blender Model 1186 was used to chop graphite fibers. The blender operated at 120 volts, 5.9 amps, and 720 watts. The blender was filled with 800 milliliters of water. 50 grams of FORTIFILL 5C brand graphite fiber cut with scissors to about one inch in length was slowly added to the water with the blender operating at its highest speed.

In this example, it was found that while the graphite fiber content was under 10 grams, it was necessary to add the graphite fibers slowly so that the fibers would not wrap around the blade. It was also found that when the graphite content was greater than 30 grams, the graphite again needed to be added slowly to prevent cavitation because the mixture was very thick. Thus, in practicing the present invention, it may be desirable to monitor the condition of the fluid mixture 64 and to control the rate of addition of graphite fibers to the fluid in response.

In a second example, however, which started with graphite fibers of about three sixteenths of an inch in length, it was found that the fiber could be added rapidly. This second example used one gram of fiber and 25 grams of water.

In another example, 15 pounds of graphite fiber were added to 55 gallons of water and mixed for about eight hours. A fifteen horsepower explosion proof dissolver from Stricklin Company of Dallas, Tex. was used. The dissolver had attached to it a Blade Shop blade Model 10-T3 sold as a ten inch diameter Design D blade by Indco, Inc. of New Albany, Ind. The blade was rotated in the mixture continuously for eight hours. The water was heated enough so that it boiled off continuously during the rotation of the blade. The average length of the resulting chopped fibers was about 1/250th of an inch, or 100 microns.

It should be noted that graphite fibers made in accordance with the present invention may be used in gas generating material manufacturing processes other than that illustrated in FIG. 2. It should also be noted that the term "mixture" of fibers and fluid is not used herein only in its strict chemical sense but is used to mean any suspension, solution, or other physical combination of fluid and fibers.

From the above description of the invention, those skilled in the art will perceive improvements, changes and modifications in the invention. Such improvements, changes and modifications within the skill of the art are intended to be covered by the appended claims.

I claim:

1. In a process of making gas generating material which includes the step of mixing graphite fibers with other materials to form gas generating material for use in an air bag inflator, the improvement comprising the steps of:

(a) obtaining graphite fibers of commercially available length;

(b) forming a mixture of said graphite fibers and an aqueous liquid, said mixture having a predetermined viscosity;

(c) adding said mixture to a container having a rotatable cutting blade therein;

(d) rotating the cutting blade rapidly and continuously to chop the graphite fibers to a shorter length, the amount of graphite fibers in said mixture being an effective amount to result in a viscosity decrease in said mixture as the fibers shorten;

(e) removing aqueous liquid from said mixture during rotation of said blade to counteract said viscosity decrease and maintain said mixture at at least said predetermined viscosity; and (f) continuing the cutting of step (d) and aqueous liquid removing of step (e) for a period of time effective to narrow the length distribution curve of the fibers.

2. A process as defined in claim 1 wherein said step of forming a mixture comprises mixing with said aqueous liquid a plurality of graphite fibers having a length of from about 3/16" to about 1", and said step of rotating the blade to chop the graphite fibers comprises chopping the graphite fibers to a length of about 100 microns.

3. A process as defined in claim 1 wherein said step of rotating the blade to chop the graphite fibers comprises chopping the fibers until the fibers exhibit a very narrow length distribution curve.

4. A process as defined in claim 1 wherein said rotating step comprises rotating the blade to chop the fibers to an average length of about 100 microns.

5. A process as defined in claim 1 wherein the aqueous liquid is water.

6. A process as defined in claim 1 wherein the container has a rubber lid to prevent adhesion of graphite fibers.

7. A process as defined in claim 1 further comprising the step of monitoring the condition of the mixture of graphite fibers in the aqueous liquid and controlling the quantity of graphite fibers in the the aqueous liquid in response to the sensed condition.

8. A process as defined in claim 1 which further includes the step of drying the graphite fibers prior to mixing them with the other materials.

9. A process as defined in claim 8 wherein said drying step includes draining the graphite fibers then heating them at an elevated temperature for a period of time.

10. A process as defined in claim 1 wherein said step (e) of maintaining at least the viscosity of the mixture in the container as the blade rotates in the container comprises vaporizing the aqueous liquid as the blade rotates, counteracting the viscosity lowering effect of shortening the fibers.

11. A process as defined in claim 1 wherein said other materials comprise a metal azide and a metal oxide, and which further includes the steps of:

drying the chopped graphite fibers;

mixing the dried graphite fibers with said metal azide and said metal oxide;

extruding the mixture of metal azide, metal oxide and graphite to form an extrudate;

forming said extrudate into spheroidal shapes; and pressing said spheroidal shapes to form bodies of gas generating material for use in an air bag inflator.

12. A process for making graphite fibers of short length and narrow length distribution curve comprising the steps of:

(a) obtaining graphite fibers of commercially available length;

(b) forming a mixture of said graphite fibers and an aqueous liquid, said mixture having a predetermined viscosity;

(c) adding said mixture to a container having a rotatable cutting blade therein;

(d) rotating the cutting blade rapidly and continuously to chop the graphite fibers to a shorter length, the amount of graphite fibers in said mixture being an effective amount to result in a viscosity decrease in said mixture as the fibers shorten;

(e) removing aqueous liquid from said mixture during rotation of said blade to counteract said viscosity decrease and maintain said mixture at at least said predetermined viscosity; and (f) continuing the cutting of step (d) and aqueous liquid removing of step (e) for a period of time effective to narrow the length distribution curve of the fibers.

13. A process as defined in claim 12 wherein said step (e) of maintaining at least the viscosity of the mixture in the container as the blade rotates in the container comprises vaporizing the aqueous liquid as the blade rotates.

14. A process as defined in claim 12 wherein said step of forming a mixture comprises adding a plurality of fibers having a length of from about 3/16" to about 1", and said step of rotating the blade to chop the fibers comprises chopping the fibers to a length of about 100 microns.

15. A process as defined in claim 12 further comprising the step of monitoring the condition of the mixture of graphite fibers in the aqueous liquid and controlling the quantity of graphite fibers in the aqueous liquid in response to the sensed condition.

* * * * *